US005287901A

United States Patent [19]

Matthews

[11] Patent Number: 5,287,901

[45] Date of Patent: Feb. 22, 1994

[54] CHIPPER KNIFE CLAMP

[76] Inventor: Steven C. Matthews, 102 Teakwood Ct., Quinton, Va. 23141

[21] Appl. No.: 17,277

[22] Filed: Feb. 12, 1993

[51] Int. Cl.[5] ..... B02C 18/18; B27C 7/06

[52] U.S. Cl. ..... 144/176; 144/162 R; 144/230; 241/92; 241/298

[58] Field of Search ..... 241/92, 298; 144/162 R, 144/172, 174, 176, 230, 218, 241

[56] References Cited

U.S. PATENT DOCUMENTS

| | | | |
|---|---|---|---|
| 3,757,839 | 9/1973 | Vanek | 144/172 |
| 3,777,793 | 12/1973 | Miller | 144/162 R X |
| 3,892,265 | 7/1975 | Vanek | 144/230 |
| 3,907,016 | 9/1975 | Nicholson et al. | 144/172 |
| 4,082,127 | 4/1978 | Miller | 144/162 R X |
| 4,771,718 | 9/1988 | Carpenter et al. | 144/176 |
| 4,784,337 | 11/1988 | Nettles | 241/92 |
| 4,850,408 | 7/1989 | Carpenter et al. | 144/241 |
| 4,887,772 | 12/1989 | Robinson et al. | 241/92 |
| 5,129,437 | 7/1992 | Nettles et al. | 144/176 |

*Primary Examiner*—W. Donald Bray
*Attorney, Agent, or Firm*—Norman B. Rainer

[57] ABSTRACT

A knife blade clamp for a Carthage-Norman type of log chipper and having a substantially right triangular cross-sectional contour having an upper face, back face and hypotenuse surface, is provided with a series of slots on its back face. The slots communicate between an elongated depression on the back face and the hypotenune surface. By virtue of the series of slots, there is less accumulation of fine dust adjacent the back face which would thwart the removability of the associated knife for servicing.

3 Claims, 2 Drawing Sheets

CHIPPER KNIFE CLAMP

BACKGROUND OF THE INVENTION

1. Field of the Invention

This invention relates to knife assemblies for disk-type chippers, and more particularly concerns an improved knife clamp which reduces the propensity for sawdust buildup behind the knife clamp.

2. Description of the Prior Art

Numerous log chippers have been disclosed in the prior art and tire in widespread industrial use. Various knife holding arrangements have been employed for disposing a sharpened blade outwardly from a cutting disc. For example, U.S. Pat. No. 3,892,265 to Vanek, U.S. Pat. No. 3,907,016 to Nicholson et al., and U.S. Pat. No. 3,777,793 to Miller disclose knife holding devices for use in log chippers. One well known chipper is described in U.S. Pat. No. 4,784,337 to Nettles et al. The chipper there described is of the well known Carthage-Norman design in which a vertically disposed disc rotates upon a horizontal drive shaft. The disc is covered by a removable housing, and a spout projects from the housing for receiving logs. The logs are fed end-on to a series of radially disposed knives carried by the disc. The knives are clamped in place at cutting stations around the front face of the disc. Chip slot passages extending through the disc are situated adjacent each cutting station. The wood chips cut from the logs move through the chip passages and are ejected from the rear face of the disc. The spout or feeder has a stationary bedknife that cooperates with the rotary knives so that the logs are cut into uniform chips suitable to be supplied, e.g., to a digester of a wood pulping process.

The blades of the knife assemblies are the parts of the chipper most subject to wear. Ideally the blades should be easy to replace and accurately adjust. In a typical use situation, the blades are changed about every 8 to 12 hours of service, sometimes more, depending on cutting conditions.

In the Carthage-Norman design, at each cutting station the knife assembly is comprised of a fixed knife holder securely fastened to the front face of the disc by means of threaded members such as studs or bolts. A knife, or knife assembly, is mounted at an angle of about thirty to forty-five degrees with respect to the associated chip slot. The cutting edge of the knife resides within the chip slot. The knife holder has a sloping abutment surface which contacts the front surface of the knife. A clamping member, seated within a recess in the front face of the disc, is urged toward the front face of the disc by means of threaded bolts whose heads are disposed on the rear face of the disc. A sloping front face on the clamping member is adapted to contact the rear surface of the knife, which contains the cutting edge. The knife is thereby sandwiched between the abutment surface of the knife holder and sloping front face of the clamping member.

A particular difficulty encountered in the use and maintenance of the Carthage-Norman chipper is the great frequency with which the knives must be removed for resharpening, and the difficulty in removing the blades.

The typical procedure for knife removal involves loosening the threaded bolts that forwardly urge the clamping member. Springs which interact between the clamping member and the disc are intended to pull the clamping member rearwardly, away from the knife.

However, with continued use, the springs become ineffective in retracting the clamping member. When this happens, forceful hammering upon the ends of the blades, and prying manipulations are required to dislodge the blade. Eventually the clamping member must be completely removed for cleaning. This practice is time consuming and requires significant machine downtime. The beating and prying on knife blades has a deleterious effect upon the blades, often causing chips and bends which require greater grinding in the sharpening process, resulting in curtailed knife blade life. Furthermore, this process diminishes the life of the disc itself which is costly to replace, and creates a major loss of machine time.

There is also a safety concern in the process of hammering and prying knife blades loose. Often a hammer, pry bar or blade may slip or drop, causing serious injury to maintenance personnel. The difficulty of changing knife blades is perceived by those in the industry as a generally disagreeable task and therefore negatively affects employee moral and job satisfaction.

It has now been found that the ineffectiveness of the springs in retracting the clamping member is caused by the accumulation of dust behind the clamping member.

It is obvious that a knife which is easier to change could greatly improve machine and parts life expectancy, productivity, industrial safety, and worker satisfaction.

It is accordingly an object of the present invention to provide an improved knife clamp for a wood chipper substantially of the Carthage-Norman type.

It is another object of the present invention to provide a clamp of the aforesaid type which has a significantly lower propensity toward sawdust collection and buildup.

It is a further object of this invention to provide a clamp of the aforesaid type which is easily loosened to provide convenience in the removal and reinstallation of a knife blade.

It is yet another object of this invention to provide a clamp of the aforesaid type which secures an associated knife blade, and is easily retrofitted to existing chippers.

It is still another object of this invention to provide a clamp of the aforesaid type which is durable and amenable to low cost manufacture.

These and other beneficial objects and advantages will be apparent from the following description.

SUMMARY OF THE INVENTION

The above and other beneficial objects and advantages are accomplished in accordance with the present invention by an improved knife clamp adapted for use in a log chipper of the Carthage-Norman design having a large vertically rotating disc having front and rear surfaces and a plurality of radially disposed cutting stations and associated elongated chip passages communicating between said front and rear surfaces, each cutting station comprised of:

a) an elongated receiving groove recessed into the front surface of said disc, b) a knife holder removably secured to said front surface and having a rearwardly facing sloping abutment surface, c) a knife blade having an upper surface and a lower surface which contacts said abutment surface, said upper surface having a sharpened front edge disposed forwardly of the front surface of said disc, and lateral extremities, d) an elongated knife clamp of an extruded form having a substantially right triangular cross section and comprising: 1) a hypotenuse holding surface adapted to contact the upper surface of said knife blade, 2) an upper face adapted to be disposed within said chip passage, and 3) a back face having an elongated depression bounded by upper and lower projections, and e) tensioning means adapted to force said knife clamp against said knife blade.

The improvement in said knife clamp comprises a plurality of slots traversing said lower projection communicating between said elongated depression and said hypotenuse surface, the area of sand slots comprising between 50% and 70% of said lower projection, two of said slots communicating with the lateral extremities of said knife blade, whereby sawdust may readily pass through said slots into an area of said receiving groove from which removal of the sawdust is easily accomplished.

BRIEF DESCRIPTION OF THE DRAWING

For a fuller understanding of the nature and objects of the it invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
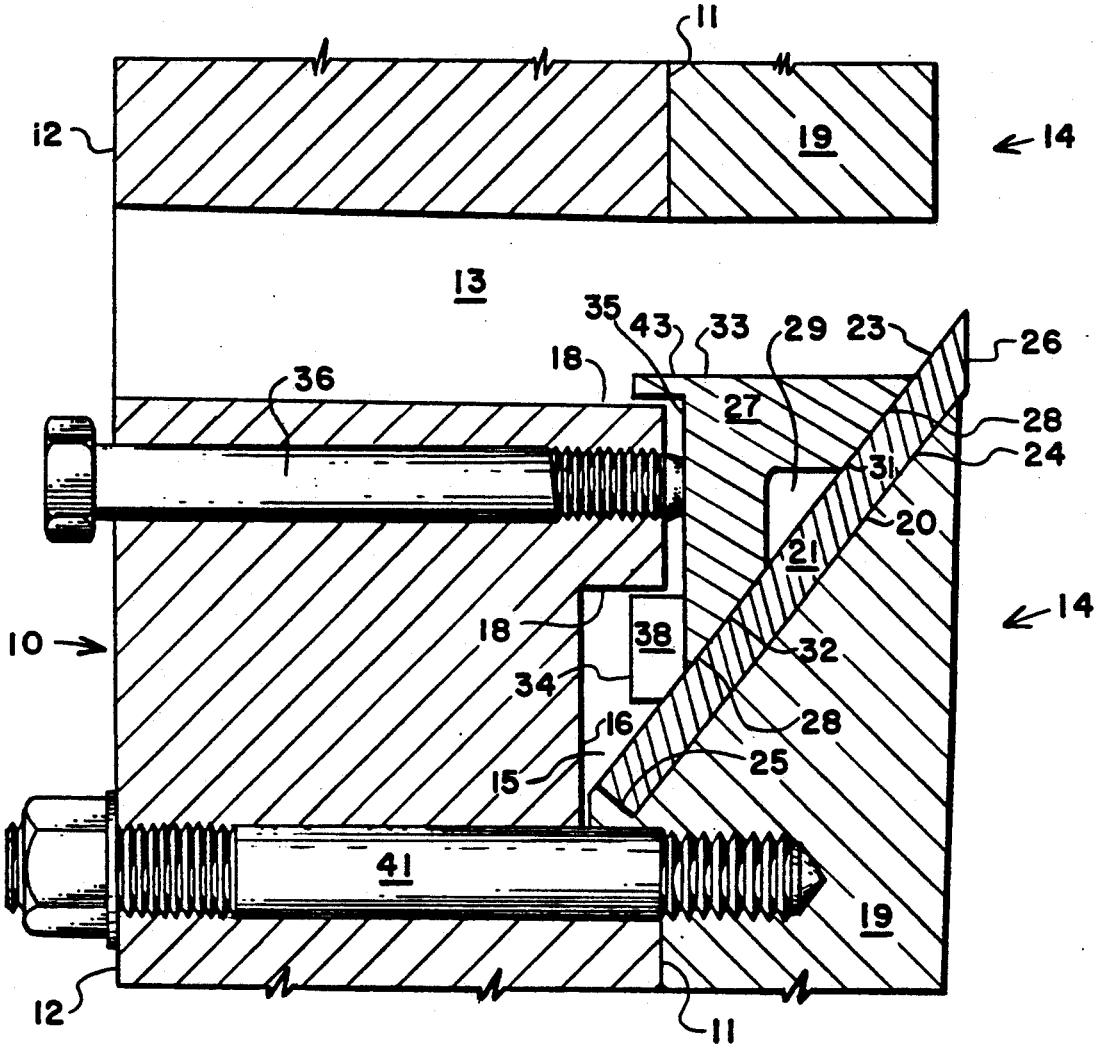
FIG. 1 is a sectional side view of an embodiment of the improved knife clamping device of the present invention shown in association with a chipper cutting disk.

Referring to FIG. 1, a fragmentary view of a conventional chipper is shown comprised of large vertically rotating disk 10 having front and rear surfaces 11 and 12, respectively, a plurality of radially disposed cutting stations 14, and elongated chip passages 13 communicating between said front and rear surfaces between cutting stations. Each cutting station 14 is associated with a receiving groove 15 recessed into front surface 11, said groove 15 having bottom surface 16. The portion of disc 10 disposed between groove 15 and associated chip passage 13 constitutes an elongated shoulder 18.

Each cutting station is further comprised of holder block 19 secured by bolt 41 to front surface 11 between successive chip passages 13, said block having sloping abutment surface 20 disposed at an angle of between 30 and 45 degrees with respect toil, front surface 11. Flat knife blade 21 is elongated between lateral extremities (not shown) and has upper surface 23 and lower surface 24 which lies in contact with abutment surface 20. Knife blade 21 has elongated rear and elongated sharpened front edges 25 and 26, respectively. Front edge 26, disposed upon upper surface 23, extends beyond said front disc surface and protrudes into chip passage 13.

Figure 2:
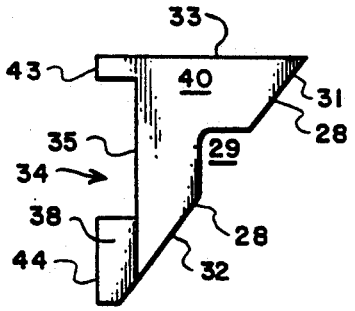
FIG. 2 is an end view of the clamping device of the embodiment of FIG. 1.
Figure 3:
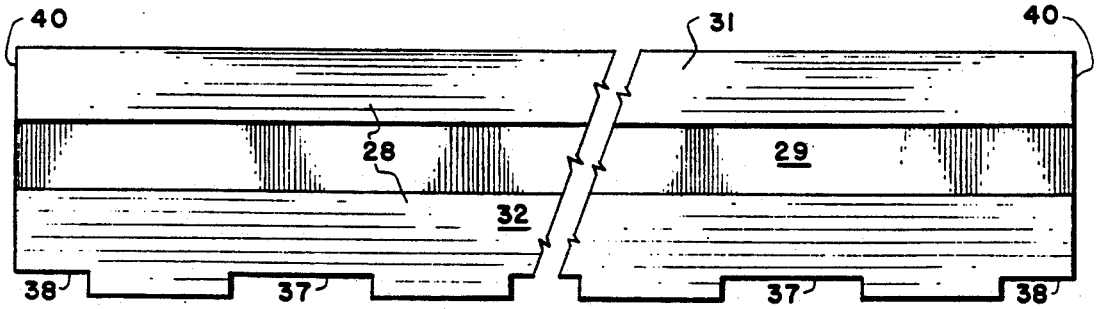
FIG. 3 is a side view taken from the right of FIG. 2.
Figure 4:
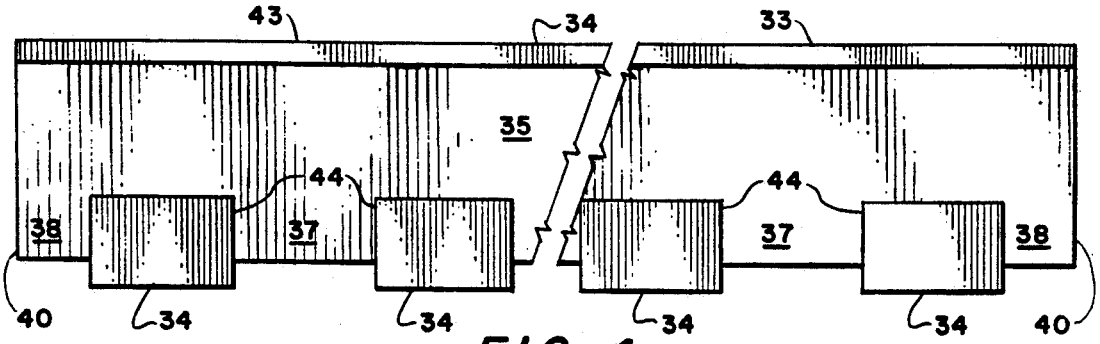
FIG. 4 is a side view taken from the left of FIG. 2.

Elongated knife clamp 27, of monolithic construction, has a substantially right triangular cross section bounded in part by bifurcated hypotenuse holding surface 28 which lies in contact with upper surface 23 of knife blade 21, and is divided by longitudinal cutout 29. Surface 28 may thereby be characterized in having upper and lower surface portions 31 and 32, respectively, adapted to exert securing pressure upon upper knife blade surface 23. Clamp 27 has elongated upper face 33 exposed to chip passage 13. As best seen in FIGS. 2-4, back face 34 of clamp 27 has elongated depression 35 bounded by upper and lower projections 43 and 44, respectively, which slidably engage shoulder 18. Tensioning means in the form of threaded stud 36 is adapted to intercede between shoulder 18 and depression 35, thereby forcing clamp 27 toward knife 21. Restoring springs (not shown) associated with disc 10 serve to urge knife clamp 27 toward said shoulder.

The improved knife clamp of the present invention, contains uniformly spaced slots 37 traversing lower projection 44 in communication between depression 36 and lower surface portion 32. The area of slots 37 comprises between 50% and 70% of the area that lower projection 44 would have if it were continuous, namely uninterrupted by the slots, as in knife clamps of the prior art. Of the several slots 37, two end slots 38 communicate with lateral extremities 40 of the knife clamp.

By virtue of the improved knife clamp 27 of this invention, sawdust that would have otherwise accumulated in depression 35, where it thwarts the function of the restoring springs, accumulates instead in the lower region of groove 15. Said accumulated sawdust in groove 15 is easily removed during regular blade changing operations when an air blasting hose is routinely fed along groove 15 while the blade is removed. The air cleaning step not only removes said accumulated sawdust, but cleans the lower part of abutment surface 20, thereby assuring proper seating of the rear or bottom edge 25 of knife blade 21. It should be noted that, in the standard procedure for removing knife blade 21, bolt 36 but not bolt 41 is loosened. Accordingly, unless clamp 27 is pulled rearwardly by the restoring springs, it becomes difficult to remove said knife blade.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. An improvement in a knife clamp adapted for use in a log chipper of the Carthage-Norman design having a large vertically rotating disc having front and rear surfaces and a plurality of radially disposed cutting stations and associated elongated chip passages communicating between said front and rear surfaces, each cutting station comprised of:

a) an elongated receiving groove recessed into the front surface of said disc, b) a knife holder removably secured to said front surface and having a sloping abutment surface, c) a knife blade having an upper surface and a lower surface which contacts said abutment surface, said knife having a sharpened front edge disposed forwardly of the front surface of said disc, and lateral extremities, d) an elongated knife clamp of an extruded form having a substantially right triangular cross section and comprising: 1) a hypotenuse holding surface configured to contact the upper surface of said knife blade, 2) a chipping surface disposed to communicate with an associated chip passage, and 3) a back face having an elongated depression and upper and lower projections, and e) tensioning means adapted to force said knife clamp against said knife blade.

said improvement comprising a plurality of slots traversing said lower projection communicating between said elongated depression and said hypotenuse surface, the area of said slots comprising between 50% and 70% of said lower projection, two of said slots communicating with the lateral extremities of said knife blade, whereby sawdust is enabled to pass through said slots into said receiving groove.

2. The improved knife clamp of claim 1 wherein said slots are of straight configuration and orthogonally disposed to said elongated depression.

3. The improved knife clamp of claim 2 wherein said slots are uniformly spaced.

* * * * *